US010513675B2

(12) United States Patent
Schmiedel et al.

(10) Patent No.: US 10,513,675 B2
(45) Date of Patent: Dec. 24, 2019

(54) WASHING LIQUOR COMPRISING A WINSOR II MICROEMULSION AND INSOLUBLE PARTICLES, AND WASHING METHOD

(71) Applicant: Henkel AG & Co. KGaA, Duesseldorf (DE)

(72) Inventors: Peter Schmiedel, Duesseldorf (DE); Michael Dreja, Neuss (DE); Christian Nitsch, Duesseldorf (DE); Arnd Kessler, Monheim am Rhein (DE); Benoit Luneau, Ratingen (DE); Reinhard Strey, Dormagen (DE); Anna Klemmer, Duesseldorf (DE); Thorsten Bastigkeit, Wuppertal (DE); Thomas Mueller-Kirschbaum, Solingen (DE); Nicole Bode, Duesseldorf (DE); Iwona Spill, Berlin (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 16/528,488

(22) Filed: Jul. 31, 2019

(65) Prior Publication Data

US 2019/0352586 A1 Nov. 21, 2019

Related U.S. Application Data

(60) Division of application No. 15/401,004, filed on Jan. 7, 2017, now abandoned, which is a continuation of application No. PCT/EP2015/065626, filed on Jul. 8, 2015.

(30) Foreign Application Priority Data

Jul. 9, 2014 (DE) ..... 10 2014 213 314

(51) Int. Cl.

| | |
|---|---|
| ***C11D 3/14*** | (2006.01) |
| ***C11D 17/00*** | (2006.01) |
| ***D06F 39/02*** | (2006.01) |
| ***D06F 35/00*** | (2006.01) |
| ***C11D 11/00*** | (2006.01) |

(52) U.S. Cl.

CPC ..... *C11D 17/0021* (2013.01); *C11D 11/0017* (2013.01); *D06F 35/006* (2013.01); *D06F 39/022* (2013.01)

(58) Field of Classification Search

CPC ..... C11D 17/0017; C11D 17/0021; C11D 11/0017; C11D 7/5004; C11D 3/12

See application file for complete search history.

(56) References Cited

U.S. PATENT DOCUMENTS

| | | | | |
|---|---|---|---|---|
| 4,655,952 | A | 4/1987 | Mesmer et al. | |
| 4,909,962 | A * | 3/1990 | Clark | C11D 1/72 510/283 |
| 5,281,354 | A | 1/1994 | Faber | |
| 5,523,013 | A * | 6/1996 | Durbut | C09K 19/00 510/235 |
| 6,121,220 | A | 9/2000 | Sandhu et al. | |
| 6,511,954 | B1 | 1/2003 | Wilbur et al. | |
| 7,786,068 | B2 | 8/2010 | Tuzi et al. | |
| 8,313,535 | B2 | 11/2012 | Schaub et al. | |
| 9,284,678 | B2 | 3/2016 | Hanau et al. | |
| 2002/0061827 | A1 | 5/2002 | Miller et al. | |
| 2008/0200565 | A1 | 8/2008 | Harwell et al. | |
| 2009/0321390 | A1 | 12/2009 | Li | |
| 2010/0047297 | A1 | 2/2010 | Petersen | |
| 2011/0132227 | A1 | 6/2011 | Hasinovic et al. | |
| 2012/0231987 | A1 | 9/2012 | Britton | |
| 2013/0085186 | A1 | 4/2013 | Wendel et al. | |
| 2013/0217611 | A1 | 8/2013 | Caballero | |
| 2013/0232700 | A1* | 9/2013 | Smith | C11D 11/0017 8/137 |
| 2014/0134255 | A1 | 5/2014 | Saito et al. | |
| 2016/0348042 | A1 | 12/2016 | Schmiedel et al. | |

FOREIGN PATENT DOCUMENTS

| | | | |
|---|---|---|---|
| DE | 1900002 | A1 | 7/1970 |
| DE | 10129517 | A1 | 1/2003 |
| DE | 102009046170 | A1 | 5/2011 |
| EP | 0160762 | A1 | 11/1985 |
| EP | 1371718 | A1 | 12/2003 |
| JP | H04241165 | A | 8/1992 |
| WO | 9203528 | A1 | 3/1992 |
| WO | 9527035 | A1 | 10/1995 |
| WO | 0171083 | A1 | 9/2001 |
| WO | 2005003268 | A1 | 1/2005 |
| WO | 2007128962 | A1 | 11/2007 |
| WO | 2010094959 | A1 | 8/2010 |
| WO | 2011073062 | A1 | 6/2011 |

(Continued)

OTHER PUBLICATIONS

PCT International Search Report PCT/EP2015/065626 Completed: Sep. 8, 2015 dated Sep. 28, 2015 4 pages.

(Continued)

*Primary Examiner* — Charles I Boyer

(74) *Attorney, Agent, or Firm* — Thomas G. Krivulka

(57) ABSTRACT

The invention relates to an aqueous washing liquor in a device for cleaning soiled textile substrates, containing a plurality of water-insoluble solid particles and a liquid phase which contains a microemulsion, and to a textile washing method using said type of washing liquor.

5 Claims, No Drawings

(56) References Cited

FOREIGN PATENT DOCUMENTS

| | | | |
|---|---|---|---|
| WO | 2011128680 | A2 | 10/2011 |
| WO | 2012035342 | A1 | 3/2012 |
| WO | 2012048911 | A1 | 4/2012 |
| WO | 2013110682 | A1 | 8/2013 |
| WO | 2013134168 | A1 | 9/2013 |

OTHER PUBLICATIONS

Phan, Tri T. et al., "Microemulsion-Based Vegetable Oil Detergency Using an Extended Surfactant", Journal of Surfactants and Detergents, XP001555826, vol. 13, Mar. 2, 2010, pp. 313-319. DOI:10.1007/s11743-010-1184-9.

* cited by examiner

WASHING LIQUOR COMPRISING A WINSOR II MICROEMULSION AND INSOLUBLE PARTICLES, AND WASHING METHOD

FIELD OF THE INVENTION

The present invention generally relates to a textile washing method which is carried out with the formation of a microemulsion or a microemulsion system, and to the washing liquor used in said method.

BACKGROUND OF THE INVENTION

There is a long-standing need to be able to remove fat stains effectively. Therefore, any washing method generally aims to remove at least hydrophobic components of the stains. In order then to have the hydrophobic components of the stains absorbed into the washing liquor, a thermodynamically attractive environment for these stains must be provided.

The prior art offers various solutions for this. One method for cleaning and impregnating functional textiles is described in international patent application WO 2006/066986 A1, wherein firstly the textiles are wetted with a so-called short liquor, that is to say a liquor which has a ratio of the weight of the amount of dry textile to the weight of the amount of water of greater than 1:8, and then a predetermined amount of a hydrophobic active substance is flushed by water out of the detergent supply chamber and into the lye container and is brought into contact with the wetted textiles. According to WO 2010/031675, the treatment composition is sprayed onto the pre-wetted laundry load in the form of fine droplets (spray).

WO 2005/003268 discloses a washing method in which the detergent is dispersed in less water than in conventional methods and thus, with a larger ratio of the amount of dry textile to the amount of water, the laundry is brought into contact with a less strongly diluted washing liquor. No special requirements are placed on the detergent formulation itself. The ratio of the weight of the amount of dry laundry to the weight of the amount of water is 1:2 to 4:1.

WO 2013/134168 A discloses a washing method in which, in at least 2 successive sub-washing cycles, the laundry is treated with a more concentrated detergent composition in the first sub-washing cycle than in a second sub-washing cycle. A washing cycle is in this case the time from creation of a washing liquor to removal of the washing liquor from the washing machine. A washing cycle can be divided into sub-washing cycles, wherein the washing liquor is not removed at the end of the first sub-washing cycle but new, additional water is fed into the existing washing liquor at the start of the second cycle. In said document, it is preferred that the first sub-washing cycle lasts longer than the second. No special requirements are placed on the detergent formulation itself.

WO 2012/048911 A discloses a washing method in a washing machine, wherein the cleaning agent and optionally different cleaning agents or components thereof are sprayed into the interior of the washing machine. The method and the control of the machine are such that much less water than in conventional methods is consumed during the cleaning and also during the rinsing. No further requirements are placed on the cleaning agents, apart from the property that they must be sprayable.

It is known that microemulsions are thermodynamically stable emulsions and have extremely low interfacial tensions. The person skilled in the art also knows that, in order to detach soil, the interfacial tension between water and the fat component of the stain must be lowered.

WO 2013/110682 A describes cleaning agents in particular for washing dishes by hand, but also for pretreating laundry, wherein the agents contain 1 to 50% by weight anionic surfactants and 1 to 36% by weight salts and spontaneously form a microemulsion upon contact with oils and/or fats. Also described are microemulsions which contain 1 to 50% by weight anionic surfactants, 1 to 36% by weight salts, 10 to 80% by weight water and 10 to 80% by weight of at least one triglyceride or a mixture of a triglyceride and one or more constituents from the group consisting of waxes, lipids, terpenes, triterpenes and fatty acids. The formation of the microemulsion takes place in situ with the triglycerides or triglyceride-containing mixtures located on the surface to be cleaned.

U.S. Pat. No. 6,121,220 A discloses acidic cleaning agents for hard surfaces, which can be in the form of a microemulsion. Use of such emulsions in a washing machine is not recommended.

Patent applications EP 0160762 A and WO 95/27035 A propose O/W microemulsions as detergents.

In German patent application DE 10129517 A, it is proposed to use microemulsions consisting of water, one or more hydrophobic components and sugar-based nonionic surfactants as spot treatment agents for textiles or for cleaning hard surfaces. The suitability of said microemulsions for use in washing machines is not described.

EP 1371718 A discloses polymeric nanoparticles having a mean particle diameter of 1 to 10 nm, which are suitable as fabric care additives in detergent formulations to improve the properties such as for example softening, crease resistance, soil and stain removal, soil release, color transfer, dye fixing, static control and anti-foam formation. The nanoparticles may be used with silicone compounds in the detergent formulation, or may be functionalized with silicone groups, in order to expand considerably different textile care properties of the preparations.

U.S. Pat. No. 4,655,952 A discloses a cleaning agent for textile surfaces, in particular textile floor coverings and a method for the production thereof. The product contains a powdered, porous carrier of a foamed, plasticized urea formaldehyde hard foam, which is enriched with cleaning agent, and contains a water-containing surfactant on the carrier, wherein the water adheres completely homogeneously in the carrier material.

JP 04241165 A relates to the treatment of a dyed natural fiber material having an appearance similar to that of a stone-washed material while avoiding the drawbacks of the stone-wash treatment, and discloses the treatment of indigo-dyed denim clothing by stirring and washing in water or in an aqueous solution of a detergent under frictional contact with solid rubber balls and contains 10-50% by weight of an abrasive such as MgO having a particle size of 60-200 mesh.

DE 1900002 A discloses solid washing and cleaning agents, surface-active substances, washing, non-surface-active cleaning salts and washing additives which contain polymers of vinyl compounds having a mean particle size of less than 1 mm.

WO 01/71083 A discloses a washing machine which has a drum for accommodating articles to be washed, wherein the drum has at least two rotatable drum sections and a drive, the drum comprises a plurality of different drum modes, including a mode in which the rotatable drum parts are driven in order to bring about a relative rotation between said drum parts. A control unit controls the appliance in order to carry out a plurality of different rinse programs, each washing program having an associated drum mode.

WO 2010/094959 A1 relates to the cleaning of substrates using a solvent-free cleaning system, which requires the use of only small amounts of water. Said document deals very particularly with the cleaning of textile fibers using such a system, and provides a device for use in this connection.

WO 2007/128962 A enables the efficient separation of the substrate from the polymer particles at the end of the cleaning process and describes a design for using two internal drums.

Finally, WO 2011/073062 A discloses bicontinuous microemulsion systems which are suitable as stain pretreatment agents and are capable of dissolving solid and solidified fat stains in the main wash cycle at a neutral pH value.

Users of washing and cleaning processes, both in the private sector and in the industrial sector, are intuitively aware that, for removing high levels of soiling, the use of a concentrated cleaning liquor with subsequent dilution leads to a better cleaning result than immediately using a diluted cleaning solution. There are many examples of this:

1. For washing the hair, shampoo is applied to the hair in concentrated form. Only once the concentrated solution has had time to act is it diluted and rinsed out.
2. For washing very dirty hands, the market offers hand wash products (for example gels or pastes, also liquid soaps) which are rubbed in as concentrates. Dilution takes place only once the cleaning product has intimately mixed with the (oily) dirt. These products are unable to be effective if they are applied in diluted form, for example are added to a sink.
3. When washing dishes, for example very greasy pots, the user intuitively applies a few drops of pure dishwashing detergent onto the sponge or directly into the pot. The cleaning result is then better or easier than when the detergent is used in dilute form in the sink.
4. In industrial cleaning processes, for example when washing the engine of a car, the dirty (oily) object is first sprayed with a cleaning agent concentrate which, after intimate mixing with the oil in the dirt, is then diluted and removed for example using a pressure washer.

The situation in the case of conventional textile washing is different. Here, the washing liquor is immediately used in relatively high dilution. The advantage in terms of the cleaning performance resulting from the action of a concentrated surfactant solution is not exploited in this case.

Without wishing to be bound to one theory, the colloidal and interface chemistry background of the higher cleaning performance of a concentrated surfactant solution is to be sought in the phase behavior of water/surfactant/oil mixtures and the resulting interfacial tension between the water and oil phases. As shown in DE 102014202990, which has not yet been published, certain surfactant systems at higher concentrations can form W/O emulsions (Winsor II systems). Upon dilution, a three-phase stage comprising a microemulsion, an excess oil phase and an excess water phase will be passed through, which is characterized by an extremely low interfacial tension and thus by a high fat solubilization capability. Upon further dilution, the type of emulsion changes to an O/W emulsion (Winsor I system). A diluted washing liquor is usually in this state.

In the teaching of the aforementioned document, a considerable saving in terms of surfactant has already been achieved by using the Winsor II system instead of a single-phase microemulsion. Of course, the same cleaning performance can also be achieved by a single-phase microemulsion, but then with a much higher input of surfactants.

The proposed agent is a concentrate which, given a certain dilution to a so-called "short liquor," results in a Winsor II system and thus provides an improved washing performance on fat stains. This Winsor II system can act on the fat stains in an early phase of the washing operation, as a kind of "full-surface pretreatment" with little wetting of the textiles and without the presence of free washing liquor, and can intimately mix with the fat stains. In a later phase of the washing operation, further dilution takes place, passing through the three-phase stage, until a Winsor I system is obtained which serves to rinse away the solubilized fat stain. In terms of the machine, the challenge when implementing this teaching lies in uniformly distributing the small amount of liquid of the "short liquor" onto the textiles in a wash load. In previous prototypes, this short liquor has been sprayed onto the wash load using a spray device. However, such machines are not commercially available.

More recently, however, alternative methods of uniformly applying a small amount of liquid to a textile load have become available. As an example, mention may be made here of polyamide flakes which are characterized by a high soil holding capacity and which are able to distribute a small amount of liquid in the wash load.

The object of the present invention is thus to provide a washing liquor which can be distributed in the form of a short liquor by water-insoluble solid particles.

Another object of the present invention is, by combining these agents, to make a washing operation more efficient, in particular to reduce the water consumption, by using the water-insoluble particles.

Furthermore, other desirable features and characteristics of the present invention will become apparent from the subsequent detailed description of the invention and the appended claims, taken in conjunction with this background of the invention.

BRIEF SUMMARY OF THE INVENTION

An aqueous washing liquor in a device for cleaning soiled textile substrates, containing a plurality of water-insoluble solid particles and a liquid phase, characterized in that the liquid phase contains a microemulsion.

The use of a plurality of water-insoluble solid particles and of a detergent which comprises a single-phase or multiphase non-solid concentrate for use as a textile detergent, wherein the concentrate is suitable to create, when diluted into a short liquor, a single-phase microemulsion or a microemulsion system of Winsor type 2, for cleaning soiled textile substrates by bringing the detergent and the particles into contact with the textile substrate.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has surprisingly been found that microemulsions in conjunction with a distribution by water-insoluble solid particles can advantageously be used as a washing medium in a washing operation. By virtue of the particles, the usual disadvantages of microemulsions are avoided, for example the high demand for surfactants or the difficult distribution of a small amount of liquid in the wash load.

It has now surprisingly been found that, in comparison to a conventional detergent on the market, a higher washing performance can be achieved if the washing solution (the aforementioned "short liquor") applied in the washing operation in conjunction with the water-insoluble solid particles is a microemulsion or contains a surfactant system which can spontaneously form a microemulsion with oil.

In the specialist literature, a microemulsion is understood to be a thermodynamically stable mixture of water, oil(s) and amphiphile(s). As is customary in emulsions, the microstructure may be O/W or W/O. In addition, bicontinuous structures are also found in microemulsions. Microemulsions are usually clear, since the droplet size thereof lies in the nm range considerably below the wavelength of visible light. In the context of the present invention, the clarity is also deemed to be an indicator of the existence of a microemulsion in a water/oil/amphiphile mixture.

According to Winsor, microemulsion systems consisting of a water component, an oil component and an amphiphile can be divided into 4 types according to their phase equilibria.

In a microemulsion system of Winsor type I, the surfactant is soluble especially in water and in an O/W microemulsion form. It consists of a surfactant-rich aqueous phase (O/W microemulsion) and an excess, but surfactant-poor oil phase.

In a microemulsion system of Winsor type II, the surfactant is soluble especially in an oil phase and in a W/O microemulsion form. It consists of a surfactant-rich oil phase (W/O microemulsion) and an excess, but surfactant-poor aqueous phase.

A microemulsion system of Winsor type III is an often bicontinuous microemulsion, also known as a middle-phase microemulsion, consisting of a surfactant-rich middle phase which coexists with a surfactant-poor aqueous phase and also a surfactant-poor oil phase.

In contrast, a microemulsion system of Winsor type IV is a single-phase homogeneous mixture and, unlike Winsor types I to III which consist of 2 or 3 phases, of which only one phase is a microemulsion, is as a whole a microemulsion. High surfactant concentrations are usually required in order to arrive at this single-phase character, whereas in microemulsion systems of Winsor type I and type II much lower surfactant concentrations are required in order to arrive at a stable phase equilibrium. For this reason, microemulsions of Winsor type IV are often described in patent literature but are rarely, if ever, used in domestic machine washing processes. The large amount of surfactant required makes such a process uneconomical and not least is also not very environmentally friendly.

In conjunction with the water-insoluble solid particles, however, the necessary amount of liquid and the substance consumption of such a system is considerably reduced, so that the latter disadvantages are overcome and a single-phase microemulsion (Winsor IV) in conjunction with the water-insoluble solid particles is a preferred embodiment of the present invention.

According to Bancroft, the type of emulsion depends both on the emulsifier and on the phase in which the emulsifier, for example a surfactant or various surfactants, dissolves. If water-soluble emulsifiers, that is to say hydrophilic emulsifiers, for example anionic surfactants, are used, O/W emulsions are produced. However, by adding electrolytes, anionic surfactants can be made more hydrophobic due to electrostatic shielding of the hydrophilic head group of the anionic surfactants, so that W/O emulsions are achieved. It is thus possible, by adding salts, to carry out a phase inversion and to convert an O/W emulsion with anionic surfactant as the emulsifier into a W/O emulsion. This can then interact with the fat-type and oil-type soil and can mix with the soil on the fiber, thereby lowering the interfacial tension between the fat-type and oil-type stains that are present and the water phase. By diluting the emulsion, the salt concentration is then reduced, the shielding of the ionic head group of the anionic surfactant becomes weaker and the anionic surfactant thus becomes more hydrophilic again. The fat-type and oil-type soil, together with the microemulsion, can thus be better detached from the textile and dispersed in the aqueous liquor and finally can be transported away with the aqueous liquor.

The behavior of the emulsifiers is also influenced by the temperature.

If hydrophobic emulsifiers, for example nonionic surfactants, are used, W/O emulsions are obtained. In this case, no addition of salt is necessary. By virtue of higher use temperatures, the nonionic surfactants become more hydrophobic and can thus better interact with fat-type and oil-type soil. If the temperature is lowered again when the liquor is diluted, the nonionic surfactants become more hydrophilic again, the fat-type and oil-type soil can thus be better detached from the textile and dispersed in the aqueous liquor and finally can be transported away with the aqueous liquor.

Phase inversions can thus be achieved in a targeted manner by adjusting the temperature and/or by adding salts.

In the context of the present invention, a surfactant system capable of forming a microemulsion will be understood to mean an aqueous surfactant system which can solubilize a relatively large amount of oil without any cloudiness being visible. In the context of the present invention, such a system contains less than 5% by weight amphiphile, preferably less than 4% by weight amphiphile, particularly preferably less than 3% by weight amphiphile and is able to solubilize, clearly, more than 0.25% by weight, preferably more than 0.5% by weight, particularly preferably more than 1% by weight of an oil. Such systems are usually characterized by a particularly low interfacial tension relative to the oil in question. Preference is given to interfacial tensions <5 mN/m, particularly preferably <3 mN/m and very particularly preferably <1 mN/m.

The microemulsion according to the invention contains:

Surfactants: nonionic surfactants, anionic surfactants, cationic surfactants and/or amphoteric surfactants. In one particular embodiment, the surfactant system of the microemulsion contains linear alkylbenzenesulfonate. The concentrations are less than 5% by weight, preferably less than 4% by weight, particularly preferably less than 3% by weight. The lower the concentration necessary to form a microemulsion, the more efficient and hence the more advantageous the surfactant system.

Optionally oils in concentrations <10% by weight, preferably <5% by weight, particularly preferably <3% by weight. Oils should be understood here to mean oils which are substantially immiscible with water. They serve in particular to detach fat-type stains. Alkanes may be used, but preference is given to biodegradable oils having ether or ester groups. The use of terpenes is also possible. One preferred oil is for example dioctyl ether.

Conventional perfume oils, which are added with the aim of fragrancing the laundry, should not be regarded here as an oil component in the context of the invention.

Optionally salts in concentrations of 0 to 10% by weight, preferably 0% by weight to 5% by weight, particularly preferably 0 to 3% by weight.

Optionally co-surfactants. Co-surfactants are amphiphiles which, due to their molecular structure, do not themselves form surfactant-typical micelles but are incorporated into the micellar structure of conventional surfactants and influence the morphology thereof and also the interface properties. Co-surfactants are for example medium-chain fatty alcohols (pentanol to dodecanol), aliphatic or aromatic alcohol ethoxylates with a low degree of EO (for example fatty alcohol ethoxylates with 1-3 EO, phenoxyethanol), monoglycerides or glycerol ethers (for example ethylhexyl glyceride), etc.

Optionally amphiphilic polymers. These serve to increase the efficiency of the surfactant system, that is to say the minimal concentration thereof above which a microemulsion can be formed.

Further customary detergent ingredients, notably enzymes, bleaching agents, builder substances, complexing agents, water-soluble solvents, optical brighteners, fragrances, etc.

Auxiliaries, for example stabilizers, rheology modifiers, colorants, etc.

In one particular embodiment, the microemulsion according to the invention contains salts but no co-surfactant.

In another particular embodiment, the microemulsion according to the invention contains co-surfactant but no salts apart from the customary amounts contained in detergents.

In another particular embodiment, the microemulsion according to the invention contains both salts and co-surfactants.

The subject matter of the present invention is thus an aqueous washing liquor in a device for cleaning soiled textile substrates, containing a plurality of water-insoluble solid particles and a liquid phase, characterized in that the liquid phase contains a microemulsion.

Since the addition of an oil component in the context of the present invention is advantageous but optional, the expression "microemulsion" in this connection always means that the system is capable of producing a microemulsion with the fat and oil components of the stain, that is to say of producing a "microemulsion-capable" system. The washing medium as such can in this case be regarded also as a "microemulsion without an oil component," particularly when a possibly sufficient amount of oil, coming from the textile substrate, is already present in the washing liquor.

For reasons of convenience, such a microemulsion would not be given directly to the consumer. Although said microemulsion contains a considerable surfactant concentration, it still also contains a large amount of water and therefore the consumer would have to carry large packages which moreover would require a high outlay on packaging. The consumer is thus given a concentrate containing little water which, when water is added, for example in a suitable diluting device in the machine, is diluted in such a way as to form a single-phase microemulsion.

In the context of the present invention, therefore, use is preferably made of a concentrate which contains the following constituents:

5 to 80% by weight surfactants optionally a co-surfactant. Co-surfactants are amphiphilic compounds which, due to their low solubility or other properties in the binary system, do not form micelles but are incorporated in the micelles and interfacial films of a conventional surfactant system and modify the properties thereof. Examples are fatty alcohols, fatty acids in protonated form, partial glycerides, low-ethoxylated nonionic surfactants optionally salts in amounts of 0% by weight to 70% by weight optionally 0 to 60% by weight of an oil component water further customary detergent ingredients and which forms a single-phase microemulsion when diluted with water by a factor of 2 to 20.

In order to avoid the disadvantages of the single-phase microemulsion, that is to say the large amount of surfactant, even in combination with water-insoluble solid particles, the teaching of the abovementioned, but not yet published, patent application DE 102014202990 can also be used in the context of the present invention, that is to say it is not a single-phase microemulsion that has to be used but rather a two-phase system of Winsor II type which, when diluted, passes through a three-phase system (Winsor II) and finally ends in a two-phase system of Winsor I type.

What is essential in the context of the present invention is therefore the use of a system of Winsor II type according to the teaching of the aforementioned patent application in conjunction with water-insoluble solid particles in a washing operation.

In a manner analogous to the single-phase microemulsions, it is also the case here that a concentrate containing little water is advantageous as the sales product.

Particular preference is therefore given to a concentrate consisting of 1 to 80% by weight, in particular 2 to 35% by weight surfactant optionally a co-surfactant salts in amounts from 20% by weight to 70% by weight 2 to 60% by weight of an oil component water further customary detergent ingredients.

Particularly in the field of industrial laundry facilities, however, the direct use of microemulsions or Winsor II systems, which together with the water-insoluble solid particles form the washing liquor according to the invention, is readily possible. The advantage of using the microemulsion directly lies in the fact that no defined dilution of the concentrate according to the invention has to take place in the washing machine. The typical disadvantage, that a large amount of water has to be transported, potentially does not play as significant a role in industrial laundry facilities since suitable conveying and transport media are available therein and a handling of relatively large amounts of liquid in tanks, barrels or canisters is readily possible.

Of course, particularly in industrial laundry facilities, the dilution of the concentrate according to the invention to give the actual microemulsion according to the invention, which together with the water-insoluble solid particles forms the washing liquor according to the invention, may also take place in an external device which is spatially separate from the actual washing machine, and the microemulsion or the Winsor II system is then introduced into the laundry treatment chamber of the washing machine.

Another aspect of the present invention encompasses a method for cleaning a soiled textile substrate, wherein the method includes treating the substrate with a formulation which comprises a plurality of water-insoluble solid particles, in which the particles, optionally after regeneration with or without the use of the microemulsions according to the invention, are reused in further cleaning methods according to the method.

The substrate comprises textile substrates, each possibly consisting of a plurality of materials which may be either a natural fiber, such as cotton, or synthetic textile fibers, for example nylon 6,6 or a polyester.

The water-insoluble solid particles may be of inorganic or organic nature. For the solid particles, particular preference is given for example to zeolites, clays or ceramic. The particles may have a certain hydrophilicity in order to enable a wetting with the washing liquor.

The organic water-insoluble solid particles may comprise any number of different polymers. Particular preference is given to polyalkenes such as polyethylene and polypropylene, polyesters and polyurethanes. However, preference is given to polymer particles composed of polyamide, very particularly particles made of nylon, most preferably in the form of nylon chips. The polyamides are particularly effective for aqueous stain/soil removal, while polyalkenes are particularly useful for removing oil-containing stains. Optionally, copolymers of the above polymeric materials can be used for the purposes of the invention.

Various nylon homopolymers or copolymers can be used, including nylon 6 and nylon 6,6. Preferably, the polyamide comprises nylon 6,6 homopolymer with a weight-average molecular weight in the range from 5000 to 30,000 daltons, preferably 10,000 to 20,000 daltons, most preferably from 15,000 to 16,000 daltons.

The water-insoluble solid particles or granules or shaped bodies are of a shape and size to enable good flowability and close contact with the textile substrate. Preferred shapes of the particles include spheres and cubes, but the preferred particle shape is cylindrical. The particles are preferably dimensioned in such a way that they each have an average weight in the range from 20-50 mg, preferably 30-40 mg. In the case of the most preferred cylindrically shaped particles, the preferred mean particle diameter is 1.5 to 6.0 mm, particularly preferably 2.0 to 5.0 mm, most preferably 2.5 to 4.5 mm, while the length of the cylindrical particles is preferably in the range from 2.0 to 6.0 mm, particularly preferably 3.0 to 5.0 mm and most preferably in the region of 4.0 mm.

Prior to the cleaning, the textile substrate may be moistened, preferably by wetting with water or else directly with the microemulsion according to the invention, in order to provide an additional improvement for the washing liquor and thus to enable an improvement of the transport properties within the system (pretreatment). This results in a more efficient transfer of active washing substances and/or of the microemulsion according to the invention onto the substrate and facilitates the removal of soil and stains from the substrate. Preferably, the wetting treatment is carried out to achieve a substrate to liquid phase weight ratio of 1:0.1 to 1:5; the ratio is more preferably between 1:0.2 and 1:2, particularly advantageous results being achieved with ratios such as 1:0.2, 1:1 and 1:2. In some cases, however, successful results can be achieved with substrate to liquid phase ratios of up to 1:50, although such ratios are not preferred because of the considerable amounts of wastewater produced. The liquid phase component of the washing liquor will be understood to be the component of the total washing liquor, including the water-insoluble solid particles, which is obtained when the water-insoluble solid particles are separated off from the liquid component by centrifuging 8 kg of the washing liquor containing the solid water-insoluble particles for 5 minutes in a centrifuge with a horizontally installed cylindrical rotating body of 515 mm internal diameter and 370 mm internal depth at 1400 revolutions per minute.

The weight ratio of the water-insoluble solid particles to the textile substrate is in general 0.1:1 to 10:1 parts by weight, in particular 0.5:1 to 5:1 parts by weight. Here, the proportion of water-insoluble solid particles is determined as the weight of the particles in the dry state, that is to say after being stored for 24 hours at 21° C. and at a relative humidity of 65%.

According to the invention, the water-insoluble solid particles may be coated with the above-described concentrate prior to use, by methods known per se.

Another subject matter of the present invention is a textile washing method in a washing machine using a washing liquor containing water-insoluble particles, as defined above, in particular in a washing machine having a washing cycle which is characterized in that

- the laundry load to be cleaned is placed into the laundry treatment chamber of the washing machine;
- a concentrate according to the invention is placed into a separate dilution device which is spatially separate from the detergent supply chamber of the washing machine;
- alternatively, the concentrate according to the invention is placed directly into the laundry treatment chamber of the washing machine, for example via a coating of the water-insoluble solid particles;
- a dilution to a "short liquor" takes place, which short liquor is transported together with water-insoluble solid particles into the laundry treatment chamber of the washing machine, wherein the short liquor is a single-phase microemulsion or a two-phase system of Winsor type II;
- alternatively, the microemulsion according to the invention or the Winsor II system according to the invention is used directly;
- the short liquor (single-phase microemulsion or Winsor type II) and the particles interact with the soil present in the laundry load, as a result of which the fat-type and oil-type soil on the fiber is loosened;
- the short liquor is diluted with water, wherein the microemulsion or the Winsor II system is transformed into a Winsor I state and is subsequently rinsed out;
- the particles are transported away.

The consumer product according to the invention, from which the washing liquor according to the invention can be produced, particularly in a washing machine which has a short liquor washing technique, is a single-phase or multiphase concentrate which at room temperature may for example be in the form of granules, liquid, gel or paste but may also be in the form of a shaped body (blocks, tablets or the like). The teaching of the invention makes use of the fact that the detergent composition used in the washing machine is a single-phase microemulsion or a microemulsion system of Winsor type II, but the concentrate which is the consumer product need not already be in the form of a microemulsion or a microemulsion system of Winsor type II. For the purposes of the invention, it is sufficient if the concentrate can be transformed into a microemulsion system of Winsor type II when diluted with water, and in particular in a washing machine. However, it may also be advantageous if the concentrate is already in the form of a microemulsion system of Winsor type II. It may also be preferred if the concentrate is in the form of a microemulsion of Winsor type IV if this can be transformed into a microemulsion system of Winsor type II at the time of creation of the washing liquor. Since a microemulsion system of Winsor type II is a two-phase system, in the interests of uniform distribution of the short liquor over the laundry it may be advantageous that the concentrate consisting of a microemulsion system of Winsor type II is not macroscopically separated at the time of use but rather application takes place in such a way that an emulsion consisting of the two phases of the Winsor type II system is applied. Such an emulsion may take place for example by suitable mixing, in particular stirring, of the microemulsion type prior to application to the laundry.

In the context of the invention, a short liquor washing technique will be understood to mean the provision of a first sub-washing cycle in which the textile or laundry load first makes contact with the washing liquor, the ratio of the weight of the dry textile or laundry load to the liquid phase of the washing liquor according to the invention being at least 1:8, but use preferably being made of a short liquor in which the ratio of the weight of the dry textile or laundry load to the liquid phase of the liquor is at least 1:4, in particular is not less than 1:2, and for example is 1:2 to 4:1, advantageously 1:2 to 2:1. In the context of the present invention, the washing method which operates with the washing liquor according to the invention consisting of a plurality of water-insoluble solid particles represents a very particularly preferred embodiment of the short liquor washing technique.

According to the invention, the aqueous liquor used in the first sub-washing cycle consists of a single-phase microemulsion or a microemulsion system of Winsor type II. In preferred embodiments of the invention, the upper limit of the weight ratio of the dry textile or laundry load to the aqueous liquor of Winsor type II is limited by the fact that it must be ensured that the entire laundry load can be completely penetrated by moisture during the first sub-washing cycle. This is because only then is it ensured that the microemulsion can interact with all the soil. In preferred embodiments of the invention, the lower limit of the weight ratio of the dry textile or laundry load to the liquid phase of the liquor of Winsor type II or of the single-phase microemulsion is given by the fact that, when used in the washing machine, there is as little "free liquor" as possible, that is to say as little excess liquor as possible that cannot be absorbed by the textile or the laundry load in the first sub-washing cycle and that remains in the sump of the washing machine. For this reason, very particular preference is given to a weight ratio of the dry textile or laundry load to the aqueous liquor of 1:2 to 1:1, in particular of not less than 1:1.5.

The concentrate preferably contains surfactants which, after dilution, serve as emulsifiers in the single-phase microemulsion or the microemulsion system of Winsor type II. In the concentrates and microemulsions, preference is given to anionic and/or nonionic surfactants, a combination of anionic and nonionic surfactants being particularly advantageous with regard to removing a wide range of different stains. The concentrates contain surfactants, and in particular a combination or anionic and nonionic surfactants, in an amount of preferably 1 to 80% by weight, in particular 5 to 30% by weight.

The microemulsions or microemulsion systems of Winsor type II used in the short liquor washing technique generally contain at least 0.05% by weight of surfactants, in particular of a combination of anionic and nonionic surfactants. Preference is given here to contents of at least 0.2% by weight, preferably from 0.3 to at most 15% by weight, in particular of a combination of anionic and nonionic surfactants.

Suitable anionic surfactants include alkylbenzenesulfonic acid salts, olefinsulfonic acid salts, $C_{12-18}$ alkanesulfonic acid salts, fatty alcohol sulfate, fatty alcohol ether sulfates, but also fatty acid soaps or a mixture of two or more of these anionic surfactants. Among these anionic surfactants, particular preference is given to alkylbenzenesulfonic acid salts, fatty alcohol (ether) sulfates and mixtures thereof.

As surfactants of the sulfonate type, mention may preferably be made of $C_{9-13}$ alkylbenzenesulfonates, olefinsulfonates, that is to say mixtures of alkenesulfonates and hydroxyalkanesulfonates and disulfonates, as are obtained for example from $C_{12-18}$ monoolefins with a terminal or internal double bond by sulfonation with gaseous sulfur trioxide and subsequent alkaline or acidic hydrolysis of the sulfonation products. Also suitable are $C_{12-18}$ alkanesulfonates and the esters of α-sulfo fatty acids (ester sulfonates), for example the α-sulfonated methyl esters of hydrogenated coconut, palm kernel or tallow fatty acids.

As alk(en)yl sulfates, preference is given to the salts of sulfuric acid semi-esters of $C_{12}$-$C_{18}$ fatty alcohols, for example from coco fatty alcohol, tallow fatty alcohol, lauryl, myristyl, cetyl or stearyl alcohol or $C_{10}$-$C_{20}$ oxo alcohols and those semi-esters of secondary alcohols of said chain lengths. For technical reasons relating to washing, preference is given to the $C_{12}$-$C_{16}$ alkyl sulfates and $C_{12}$-$C_{15}$ alkyl sulfates, as well as $C_{14}$-$C_{15}$ alkyl sulfates. 2,3-alkyl sulfates are also suitable anionic surfactants.

Fatty alcohol ether sulfates are also suitable, such as the sulfuric acid monoesters of the straight-chain or branched $C_{7-21}$ alcohols ethoxylated with 1 to 6 mol of ethylene oxide, such as 2-methyl-branched $C_{9-11}$ alcohols with on average 3.5 mol of ethylene oxide (EO) or $C_{12-18}$ fatty alcohols with 1 to 4 EO, in particular $C_{12-14}$ fatty alcohols with 2 EO.

Other suitable anionic surfactants are fatty acid soaps. Saturated and unsaturated fatty acid soaps are suitable, such as the salts of lauric acid, myristic acid, palmitic acid, stearic acid, (hydrogenated) erucic acid and behenic acid, and also soap mixtures derived in particular from natural fatty acids, for example coconut, palm kernel, olive oil or tallow fatty acids. The fatty acid soap content in the concentrates is preferably 0 to 5% by weight.

The anionic surfactants including the fatty acid soaps may be present in the form of their sodium, potassium or magnesium or ammonium salts. Preferably, the anionic surfactants are in the form of their sodium salts and/or ammonium salts thereof. Amines which can be used for neutralization are preferably choline, triethylamine, monoethanolamine, diethanolamine, triethanolamine, methylethylamine or a mixture thereof, preference being given to monoethanolamine.

Suitable nonionic surfactants include alkoxylated fatty alcohols, alkoxylated oxo alcohols, alkoxylated fatty acid alkyl esters, fatty acid amides, alkoxylated fatty acid amides, polyhydroxy fatty acid amides, alkylphenol polyglycol ethers, amine oxides, alkyl polyglucosides and mixtures thereof.

As alkoxylated fatty alcohols, use is preferably made of ethoxylated, in particular primary alcohols having preferably 8 to 18 C atoms and on average 2 to 12 mol of ethylene oxide (EO) per mole of alcohol, in which the alcohol radical is linear. Particular preference is given to alcohol ethoxylates having 12 to 18 C atoms, for example from coconut alcohol, palm alcohol, tallow fatty alcohol or oleyl alcohol, and on average 5 to 8 EO per mole of alcohol. The preferred ethoxylated alcohols include for example $C_{12-14}$ alcohols with 2 EO, 3EO, 4 EO or 7 EO, $C_{9-11}$ alcohol with 7 EO, $C_{12-18}$ alcohols with 3 EO, 5 EO or 7 EO, $C_{16-18}$ alcohols with 5 EO or 7 EO and mixtures thereof. In addition to these nonionic surfactants, use may also be made of fatty alcohols with more than 12 EO. Examples of these are tallow fatty alcohol with 14 EO, 25 EO, 30 EO or 40 EO. It is particularly preferred that a $C_{12-18}$ alcohol, in particular a $C_{12}$-$C_{14}$ alcohol or a $C_{13}$ alcohol with on average 2 EO or 3 EO is used as the nonionic surfactant.

Besides the pure ethylene oxide adducts, however, corresponding propylene oxide adducts and in particular also EO/PO mixed adducts are also advantageous, particular preference being given to $C_{16}$-$C_{18}$ alkyl polyglycol ethers with in each case 2 to 8 EO and PO units. In some embodiments, preference is also given to EO/BO mixed adducts and even EO/PO/BO mixed adducts. The particularly preferred EO/PO mixed adducts include $C_{16}$-$C_{18}$ fatty alcohols with fewer PO than EO units, in particular $C_{16}$-$C_{18}$ fatty alcohols with 4 PO and 6 EO or $C_{16}$-$C_{18}$ fatty alcohols with 2 PO and 4 EO.

The specified degrees of ethoxylation (EO=ethylene oxide; PO=propylene oxide; BO=butylene oxide) are statistical averages which, for a specific product, may be an integer or a fractional number. Preferred alkoxylates have a narrow homolog distribution.

As already shown above, inorganic salts are not absolutely necessary in order to be able to produce single-phase microemulsions or microemulsions of Winsor type II. However, preference is given to concentrates, in particular concentrates containing anionic surfactants, which contain one or more inorganic salts. Preferred inorganic salts are alkali metal sulfates and alkali metal halides, in particular chlorides, and also alkali metal carbonates. Very particularly preferred inorganic salts are sodium sulfate, sodium hydrogen sulfate, sodium carbonate, sodium hydrogen carbonate and mixtures thereof. The content of one or more inorganic salts in the concentrates is preferably 0 to 70% by weight. In the microemulsions or microemulsion systems of Winsor type II, the content of one or more inorganic salts is 0 to 20% by weight and preferably 5 to 15% by weight, concentrations of 8 to 12% by weight having proven to be particularly preferred.

In preferred embodiments of the invention, the concentrates also contain one or more additional oils. In the context of the present invention, an additional oil which is used deliberately and in addition to the fat-type and oil-type stains present on the textiles to be washed is in principle any organic, non-surfactant liquid which is immiscible with water or forms 2 phases in combination with water and which itself has a fat dissolving capability. Particular preference is given to those additional oils which not only have a good fat dissolving capability but also are biodegradable and acceptable in terms of odor. Particularly preferred concentrates contain as the additional oil dioctyl ether, oleic acid, limonene, low-molecular-weight paraffins and/or low-molecular-weight silicone oils, for example including the solvent Cyclosiloxane D5 known from chemical cleaning. Aromatic solvents such as toluene are of course also effective additional oils for the purposes stated here; however, these are usually omitted for toxicological reasons. The content of one or more additional oils in the concentrates is preferably 0 to 60% by weight and in particular 2 to 50% by weight.

The use of one or more additional oils in the concentrate according to the invention has several advantages. First, additional oils act as a solvent for the fats which are in solid form at the use temperatures in the washing machine. Furthermore, the oil-type and fat-type soil on the laundry is usually not precisely defined. It is therefore not known from the outset which surfactants must be contained in the W/O emulsion in order actually to interact with the soil in such a way that the latter is loosened and can be rinsed out from the textile. Added to this is the fact that, without the presence of additional oils, the fat-type and oil-type soil on the textiles could bring the microemulsion system out of equilibrium. However, if an additional hydrophobic component as defined above (additional oil) is used in the concentrate from the outset, the effect that the fat-type and oil-type soil on the laundry has on the equilibrium of the microemulsion is negligible and the likelihood of a desired interaction and loosening of the soil on the textile fiber is considerably increased.

In the single-phase microemulsions or microemulsion systems of Winsor type II to be created, the content of one or more additional oils is preferably 0 to 20% by weight and in particular 0.5 to 15% by weight, concentrations of 1 to 12% by weight having proven to be particularly preferred.

In particular, microemulsion systems of Winsor type II which contain 0.1 to 5% by weight surfactants, advantageously 0.2 to 1% by weight surfactants, particularly preferably less than 0.1% by weight surfactants, and 0.5 to 5% by weight, advantageously 1 to 3% by weight additional oils can be produced from the concentrates according to the invention by diluting with water. More preferably, the aforementioned microemulsion systems of Winsor 2 type contain 80 to 94.6% by weight water and 0 to 15% by weight inorganic salts, preferably 1 to 12% by weight inorganic salts, in particular 5 to 10% by weight inorganic salts.

In other embodiments, it is preferred that the concentrates contain inorganic salts and/or additional oils. Particularly when anionic and nonionic surfactants are contained in the concentrates, it has proven to be particularly advantageous that the concentrates contain both one or more inorganic salts and also one or more additional oils. The weight ratio of inorganic salt to additional oil may vary within a broad scope depending on the surfactants used. Particularly preferred additional oils which are present in combination with inorganic salts are di-ethers. With particular advantage, use is made of di-n-octyl ether.

In addition, the concentrate may also contain at least one, preferably two or more constituents selected from the following group: builders, bleaching agents, electrolytes, non-aqueous but water-miscible solvents, enzymes, pH adjusters, perfumes, perfume carriers, fluorescence agents, dyes, hydrotropes, foam inhibitors, silicone oils, anti-redeposition agents, graying inhibitors, shrinkage inhibitors, anti-crease agents, dye transfer inhibitors, antimicrobial active substances, germicides, fungicides, antioxidants, preservatives, corrosion inhibitors, anti-static agents, bittering agents, ironing aids, repellent and impregnation agents, swelling and anti-slip agents, softening components and UV absorbers.

As builders which may be contained in the concentrate, mention may be made in particular of silicates, aluminum silicates (in particular zeolites), carbonates, salts of organic di- and polycarboxylic acids and mixtures of said substances.

Organic builders which may be present in the concentrate are for example the polycarboxylic acids which can be used in the form of their sodium salts, polycarboxylic acids being understood to mean those carboxylic acids which carry more than one acid function. Examples of these are citric acid, adipic acid, succinic acid, glutaric acid, malic acid, tartaric acid, maleic acid, fumaric acid, sugar acids, aminocarboxylic acids and mixtures thereof. Preferred salts are the salts of polycarboxylic acids such as citric acid, adipic acid, succinic acid, glutaric acid, tartaric acid, sugar acids and mixtures thereof.

Also suitable as builders are polymeric polycarboxylates. These are for example the alkali metal salts of polyacrylic acid or of polymethacrylic acid, for example those having a relative molecular mass of 600 to 750,000 g/mol. Suitable polymers are in particular polyacrylates which preferably have a molecular mass of 1000 to 15,000 g/mol. Due to their superior solubility, preference may in turn be given in this group to short-chain polyacrylates which have molecular masses of 1000 to 10,000 g/mol, and particularly preferably 1000 to 5000 g/mol.

Also suitable are copolymeric polycarboxylates, in particular those of acrylic acid with methacrylic acid and of acrylic acid or methacrylic acid with maleic acid. In order to improve the solubility in water, the polymers may also contain allylsulfonic acids, such as allyloxybenzenesulfonic acid and methallylsulfonic acid, as monomer.

Preferably, however, soluble builders, such as for example citric acid, or acrylic polymers having a molecular mass of 1000 to 5000 g/mol are used in the liquid detergents.

In addition to the additional oils, nonaqueous solvents which are miscible with water may be added to the microemulsion systems or to the concentrate used to produce the microemulsions. Suitable nonaqueous solvents include mono- or polyvalent alcohols, alkanolamines or glycol ethers. By way of example, the solvents are selected from ethanol, n-propanol, i-propanol, butanols, glycol, propanediol, butanediol, methyl propanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol monomethyl ether, dipropylene glycol monoethyl ether, methoxytriglycol, ethoxytriglycol, butoxytriglycol, 1-butoxyethoxy-2-propanol, 3-methyl-3-methoxybutanol and mixtures of said solvents. However, account should be taken here of the fact that the type and amount of the nonaqueous but water-miscible solvents must be selected in such a way that a microemulsion system of Winsor type II can be produced when the short liquor is created.

In a further embodiment of the invention, use is made of anhydrous or at least almost anhydrous concentrates which preferably essentially contain only as much water as is introduced by the raw materials used to produce said concentrates, without water actively being added. In the context of the present invention, almost anhydrous will be understood to mean that the water content in the concentrates is not more than 2% by weight, preferably not more than 1% by weight. In one preferred embodiment of the invention, the concentrates are in the form of an anhydrous paste which contains surfactants, in particular a mixture of anionic and nonionic surfactants. Advantageously, the surfactant content, in particular of the mixture of anionic and nonionic surfactants, in the anhydrous pastes lies in the same ranges as in the case of the water-containing concentrates. The same also applies to the other constituents of the concentrates. In place of the water, the pastes may in preferred embodiments contain additional fine-particle solids, for example aluminosilicates, such as zeolites or smectites or bentonites, or also silicas, for example of the Aerosil® type. These fine-particle additives do not significantly affect the phase boundaries and the stability of the microemulsion systems of Winsor type II to be produced from the pastes.

The concentrates according to the invention can be produced by any method known from the prior art.

It is also preferred to offer the concentrates according to the invention in the form of individual portions. These include in particular containers made of water-soluble materials, which are filled with the concentrates according to the invention. Particular preference is given to single-chamber or multi-chamber containers, especially made of polyvinyl alcohol or polyvinyl alcohol derivatives or copolymers with vinyl alcohol or vinyl alcohol derivatives as monomer. These individual portions ensure that the amount of concentrate according to the invention that is correct for creating the microemulsion system of Winsor type II and for the associated corresponding performance is used in the first sub-washing cycle. Where necessary, multiple individual portions can also be used depending on the amount of textile or laundry load to be washed.

A further embodiment of the invention provides that the concentrates are in granulated form on a carrier. Suitable carrier materials are the carrier materials known from the prior art for detergents. Particular preference is given to ingredients of detergents, such as builders and alkalizing agents, for example alkali carbonates or zeolites, or bleaching agents such as percarbonates or enzyme granulates, but also sodium sulfates or silicates and in particular those substances which have a high liquid absorption capability, for example silicas. Such granulated products may also be powder-coated with fine-particle materials, which are known for this purpose from the prior art. Particular preference is given to silicas, zeolites or other aluminosilicates, but also to mixtures of silicas and zeolites.

Another subject matter of the invention is the use of a concentrate as described above to form a short liquor of a microemulsion system of Winsor type II. All the details and embodiments described in respect of the concentrates also apply to the use.

In one preferred embodiment of the textile washing method according to the invention, use is made of a washing machine, in particular a domestic washing machine, having a washing cycle which includes at least two successive sub-washing cycles, wherein

- in the first sub-washing cycle a short liquor is present in the laundry treatment chamber of the washing machine,
- an interaction of the short liquor with the soil present in the laundry load takes place in the first sub-washing cycle, as a result of which the interfacial tension between the fat-type and oil-type stains and the water phase is lowered,
- then in at least one further sub-washing cycle the liquor is diluted with water until a long liquor is formed,
- during this the soil is loosened from the laundry load and
- at the end of the last sub-washing cycle the soil together with the long liquor is transported away from the laundry treatment chamber.

This embodiment of the method provides that a washing cycle comprising 2 successive sub-washing cycles is carried out. A washing cycle is the period of time from creation of a first washing liquor to removal of the washing liquor from the washing machine. The washing cycle is divided into at least two sub-washing cycles, the washing liquor not being removed at the end of the first to penultimate sub-washing cycle. In the preferred embodiment, which provides a washing cycle that comprises 2 successive sub-washing cycles, at the start of the first sub-washing cycle the short liquor is formed in the form of a microemulsion or a microemulsion system of Winsor type II, or, if the concentrate used already exists as a microemulsion system of Winsor type II, is retained as such, while at the start of the second sub-washing cycle new additional water is fed into the already existing washing liquor so as to form a long liquor. During this dilution, which can also be regarded as a first rinsing step, a breaking of the single-phase microemulsion or a phase inversion of the Winsor II system takes place and usually a Winsor I emulsion is produced.

A method according to the invention is preferably carried out in a washing machine which permits a short liquor washing technique. What has already been stated above applies accordingly to the short liquor washing technique and to the short liquor. The machines in question permit the use of concentrates or granulated concentrates to create a short liquor in the machine. Particular preference is given here to washing machines in which the short liquor is distributed by a plurality of water-insoluble solid particles.

Since a microemulsion system of Winsor type II is a two-phase system, preference is given to a method which, in the interests of uniform distribution of the short liquor over the laundry load, provides that the microemulsion system of Winsor type II is not in macroscopically separated form during the application but rather is introduced into the laundry treatment chamber and applied to the laundry load as an emulsion of the two phases. This temporary emulsion can be formed for example by vigorous mixing, in particular by stirring.

In one particular embodiment, the machine measures the weight of the dry textile or laundry load and supplies the amount of water necessary to form the short liquor. Said water is mixed with the concentrates according to the invention in the aforementioned mixing device or directly in the laundry treatment chamber of the machine, so as to form a single-phase microemulsion or a microemulsion system of Winsor type II. Likewise, in one particular embodiment, the water-insoluble solid particles, which together with the short liquor form the washing liquor according to the invention, may be coated beforehand with the concentrates according to the invention. The amount of water necessary to create the microemulsion system is then metered into or outside of the washing drum. In order to be able to produce a temporary emulsion of the microemulsion system of Winsor type II, which per se consists of two phases, it may be preferred that the machine provides a chamber in which a temporary emulsion can be formed from the concentrate and the supplied water. This may be aided by providing a mixing device, preferably a stirring device, in this mixing chamber. The mixing chamber for producing a temporary emulsion may be the dispensing drawer of a washing machine, in particular of a domestic washing machine, but may also be an additional chamber in the machine, in particular the domestic washing machine.

It is also preferred that the machine, after determining the weight of the laundry load, displays the weight thereof in a manner readable by the consumer or the commercial user, so that the consumer can dose the appropriate amount of concentrate. The appropriate dosage amounts of the concentrate as a function of the weight of the laundry load, which are necessary for forming the microemulsion system of Winsor type II, can be read by the consumer on the packaging of the concentrate and/or are displayed by the machine itself in the case of a suitably programmable machine.

Since any free washing liquor, that is to say liquor which cannot be absorbed by the laundry load or which is located in the intermediate spaces of the water-insoluble solid particles and remains in the sump of the machine, would result in unnecessary dilution of the system and possibly even in an impairment of the washing result, the method according to the invention provides that as little free liquor as possible arises. It has proven to be advantageous if a ratio of the weight of the dry textile or laundry load to the short liquor of at least 1:8, preferably at least 1:4, in particular not less than 1:2, for example of 1:2 to 4:1 is formed in the first sub-washing cycle. In particular, it is preferred if a ratio of the weight of the dry textile or laundry load to the short liquor of not less than 1:1.5 is formed in the first sub-washing cycle. In particular methods, this ratio may be 1:1.2 to 1.2:1, ideally even 1:1.

The uniform distribution of the short liquor over the laundry load takes place in the washing machine by the plurality of water-insoluble solid particles which are rolled around together with the liquid and the laundry load. For introducing the short liquor into the laundry treatment chamber, use may also preferably be made of an injection, spray or pump system, for example a circulating pump.

In one preferred embodiment of the invention, a method is proposed which provides a ratio of the weight of the dry textile or laundry load to the short liquor of 1:2 to 1:1.5, the short liquor being distributed by means of a circulating pump.

In one preferred embodiment, at the end of the first sub-washing cycle, the washing liquor, which according to the invention includes the water-insoluble solid particles, is not removed.

In a further preferred embodiment, at the end of the first sub-washing cycle, any free liquor, that is to say any liquor which is not bound in the textiles or the intermediate spaces of the water-insoluble solid particles, is removed, but not the particles themselves.

In a further preferred embodiment, at the end of the first sub-washing cycle, the water-insoluble solid particles are removed from the laundry treatment chamber of the machine and are moved into a reservoir outside of the laundry treatment chamber.

In a further preferred embodiment, at the end of the first sub-washing cycle, the water-insoluble solid particles are removed from the laundry treatment chamber and are replaced by others not acted upon by the short liquor. In this way, parts of the short liquor can be used multiple times.

At the start of the second sub-washing cycle, additional water is fed in, which ultimately leads to the formation of a liquor of the type known from conventional washing methods. In the context of the present invention, this most diluted liquor is known as the long liquor for the purpose of better differentiation from the short liquor. In the context of the present invention, the long liquor may also be the result of a first rinsing operation. In the context of the present invention, the liquor which comprises the dilution stages of the short liquor until the long liquor is obtained is referred to as the dilution liquor. During the dilution of the short liquor until the long liquor is formed, the concentration of the detergent in the liquor is decreased. Furthermore, in one preferred embodiment, the hydrophilicity and water-solubility of a nonionic surfactant preferably contained therein is increased as a result of the dilution of the concentration of the salt preferably contained therein. As a result, a phase inversion is brought about, wherein firstly a microemulsion system of Winsor type III and lastly, upon further dilution, an emulsion system of Winsor type I is formed. Without wishing to be limited to this theory, the applicant assumes that the formation of the microemulsion system of Winsor type III is responsible for the improved detachment of the soil loosened by the microemulsion system of Winsor type II. A person skilled in the art knows that the interfacial tension in the three-phase stage of the microemulsion system of Winsor type III is very low. It is also known that low interfacial tensions promote the detachment of fat. Another advantage of the low interfacial tensions of the microemulsion systems of Winsor type III is that, due to the better fat-dissolving power, it is possible to use less surfactant than in single-phase microemulsions of Winsor type IV, as a result of which the method can be made more economical and more environmentally friendly. The interplay of the microemulsion system of Winsor type II in the short liquor in the first sub-washing cycle and the microemulsion systems of Winsor type III and of Winsor type I in the second sub-washing cycle or the further sub-washing cycles then leads to the particularly good washing results.

Nevertheless, washing liquors consisting of the water-insoluble solid particles and a single-phase liquid phase of Winsor type IV also form the subject matter of the invention since the combination with the particles overcomes many disadvantages of the single-phase Winsor IV microemulsion in a conventional washing method.

As already described, the second sub-washing cycle is started by the introduction of water, as a result of which the short liquor is diluted. If the addition of the rest of the water up to the point of final dilution and thus formation of the long liquor takes place without further temporal interruption, the phase inversion via the microemulsion system of Winsor type III to the microemulsion system of Winsor type I takes place in the second sub-washing cycle.

However, it may be advantageous if the dilution of the short liquor to the long liquor takes place in individual stages, that is to say with interruptions in the addition of water. In one particularly preferred embodiment of the invention, therefore, a textile washing method as described above is carried out, in which the phase inversion takes place during the second sub-washing cycle or during the further sub-washing cycles, wherein firstly a microemulsion system of Winsor type III and lastly of Winsor type I is formed. Particular preference is given to a method which is characterized by running through at least 3 sub-washing cycles, wherein the second sub-washing cycle comprises the production of a microemulsion system of Winsor type III as a dilution liquor and the third sub-washing cycle comprises the washing method using the long liquor, that is to say the final amount of water introduced, optionally until the long liquor is transported away. The second sub-washing cycle may comprise a plurality of stages which represent different dilution stages, but in all stages a microemulsion system of Winsor type III exists. As soon as the dilution has proceeded so far that the phase inversion to Winsor type I takes place, the third washing cycle begins. A further addition of water in this third sub-washing cycle is of course possible, but is neither necessary for performance reasons nor desirable for ecological or economic reasons and therefore is not preferred.

In a further preferred embodiment of the method, the heating of the machine is switched on in the first sub-washing cycle, and in particular only in the first sub-washing cycle, whereas the heating is preferably switched off in the second sub-washing cycle and—if present—in further sub-washing cycles and in optionally subsequent rinsing cycles.

Alternatively, for producing the microemulsion systems of the short liquor, the machine may also be supplied with water that has been heated by an internal or external heating device, which then cools down in the course of the first sub-washing cycle. The dilution to the long liquor then takes place preferably with cold water. This has advantages in particular when the single-phase microemulsion or the microemulsion system of Winsor type II in the short liquor contains nonionic surfactants. Nonionic surfactants become more hydrophobic as the temperature increases, and more hydrophilic as the temperature decreases. The heated nonionic surfactants give rise to a higher hydrophobicity of the short liquor, as a result of which the interaction with fat-type and oil-type soil and the loosening thereof on the textiles is improved, whereas the nonionic surfactants in the cooling dilution liquor and the colder long liquor become more hydrophilic and can be better rinsed out by the water and transported away together with the soil. In this preferred method, therefore, the breaking of the microemulsion or the phase inversion from the Winsor II system to the Winsor I system, which otherwise are triggered only by the dilution, is further aided by the temperature control of the process.

In one preferred embodiment of the method, therefore, it is provided that the first sub-washing cycle is carried out at temperatures of 10 to 60° C., preferably of at least 20 to 40° C.

In addition, the method has the advantage that, unlike in conventional methods, heating energy is consumed only in the first sub-washing cycle. Since the first sub-washing cycle contains only a short liquor, energy is saved in comparison to conventional methods in which a long liquor, that is to say a larger amount of aqueous liquor, must be heated.

Finally, the soil together with the long liquor, optionally after running through further sub-washing cycles, is transported away and removed from the laundry treatment chamber of the washing machine.

A further embodiment of the invention is a device for cleaning soiled textile substrates, comprising a plurality of water-insoluble solid particles, a reservoir for accommodating the particles inside or outside of the device, and a washing liquor according to the invention.

One essential feature of the device according to the invention is the presence of the abovementioned water-insoluble solid particles, and a reservoir for the particles. The device according to the invention typically has a hinged door in a housing for enabling access to the interior of the washing drum, in order to provide a substantially closed system. Preferably, the door closes an opening of the stationary cylindrical drum, which is rotatably mounted in a further drum, while the rotatably mounted cylindrical drum is fitted vertically within the housing. A front-loading device is therefore preferred. Alternatively, the stationary cylindrical drum may be fitted vertically inside the housing and the access means may be located in the top side of the device.

The device is suitable for providing contact of the particles and of the washing liquor according to the invention with the soiled substrate. Ideally, said particles should be effectively circulated in order to promote effective cleaning.

According to the invention, the device comprises at least one reservoir, in particular with a suitable control system, for the water-insoluble solid particles, which reservoir is located for example inside the washing machine and is suitable for controlling the flow of the particles within the washing machine and contains the particles for regeneration.

It has additionally been found that, by virtue of the measures of the method according to the invention, the regeneration of the water-insoluble solid particles is possible and the particles can be satisfactorily reused in the cleaning method, although a certain degree of worsening of the performance can generally be observed after three uses of the particles. When reusing the particles, optimal results are achieved if said particles are again coated with the concentrate prior to being reused.

The regeneration of the water-insoluble solid particles may take place in a manner known per se, as described for example in WO 2012/035342 A1. In the context of the present invention, the regeneration takes place by introducing the particles, optionally with the detergent, into the decoloring device for example in a separate rinsing cycle, optionally by adding cleaning agents which may even be of aggressive nature. The temperature of the regeneration step depends on the washing temperature if the textile substrate was removed from the washing machine prior to the regeneration. The usual detergent raw materials can also be used.

EXAMPLES

Example 1

Table 1 (formulation numbers 2 to 7) describes microemulsions and surfactant systems capable of forming microemulsions, which can be used together with water-insoluble solid particles in a textile washing method according to the invention:

TABLE 1

| | | Formulation No. | | | | | | |
|---|---|---|---|---|---|---|---|---|
| | % AS | 1 % | 2 % | 3 % | 4 % | 5 % | 6 % | 7 % |
| Cetiol ® OE | 100 | | | 1.00 | | 1.00 | | 1.00 |
| Dehydol ® LT7 | 100 | 1.35 | 1.35 | 1.35 | 1.35 | 1.35 | 1.35 | 1.35 |
| Maranil ® A55 | 58 | 1.65 | 1.65 | 1.65 | 1.65 | 1.65 | 1.65 | 1.65 |
| Hexanol | 100 | | 2.00 | 2.00 | 2.50 | 2.50 | 3.00 | 3.00 |
| Water | 100 | 97.00 | 95.00 | 94.00 | 94.50 | 93.50 | 94.00 | 93.00 |
| Salt (NaCl) | 100 | | | | | | | |

Cetiol ® OE: Dicapryl ether
Dehydol ® LT7: Nonionic surfactant, C12/18 + 7EO, BASF
Maranil ® A55: Linear alkylbenzenesulfonate (LAS)

The amounts are given in percent by weight based on the total detergent, and refer to the active substance content (% AS) of the specified ingredients.

In these systems, the co-surfactant hexanol serves to enter the single-phase microemulsion phase. Salt is not necessary here. The oil component is Cetiol® OE. These formulations, which are obtained from a concentrate also according to the invention by dilution with water, are used directly in a washing operation together with polyamide particles as cleaning medium. Even in the presence of the oil, they are single-phase and clear, which in the context of the present invention can be deemed to be an indicator of the existence of a microemulsion.

In the table above, formulation 1 without co-surfactant serves as a comparative example not in accordance with the invention. Said formulation contains only a traditional surfactant mixture consisting of LAS and a nonionic surfactant.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A textile washing method comprising the step of contacting a soiled textile substrate in a washing machine with a washing liquor concentrate comprising:

a) a plurality of water-insoluble solid particles; and b) a liquid phase, wherein the liquid phase comprises a microemulsion;

wherein the contacting step comprises introducing a laundry load into a washing cycle having at least two successive sub-washing cycles, and involves the following steps:

i) the laundry load to be cleaned is introduced into the laundry treatment chamber of the washing machine;

ii) the concentrate is placed into a detergent supply chamber of the washing machine, and in the first sub-washing cycle is transported into the laundry treatment chamber of the washing machine, while simultaneously forming a short liquor, wherein a microemulsion system of Winsor type 2 is formed or retained as the short liquor;

iii) an interaction of the short liquor of Winsor type 2 with the soil present in the laundry load takes place in the first sub-washing cycle, as a result of which a loosening of the fat-type and oil-type soil on the fiber is brought about;

iv) in at least one further sub-washing cycle the liquor is diluted with water and continues to be diluted with water until a long liquor is formed, wherein the soil is detached from the laundry load;

v) at the end of the last sub-washing cycle the soil together with the long liquor is transported away from the laundry treatment chamber.

2. The textile washing method according to claim 1, wherein the microemulsion system of Winsor type 2 is not in macroscopically separated form during application but rather is introduced into the laundry treatment chamber of the machine and applied to the laundry load as an emulsion of the two phases of the microemulsion system of Winsor type 2.

3. The textile washing method according to claim 1, wherein in the first sub-washing cycle, a weight ratio of the soiled dry textile substrate or laundry load to the short liquor of not less than 1:2, is formed.

4. The textile washing method according to claim 1 wherein a phase inversion takes place during the sub-washing cycle following the first sub-washing cycle or the further sub-washing cycles following the first sub-washing cycle, and wherein firstly a microemulsion system of Winsor type 3 and lastly of Winsor type 1 is formed.

5. The textile washing method according to claim 1 wherein at least 3 sub-washing cycles are carried out, wherein the second sub-washing cycle comprises the production of a microemulsion system of Winsor type 3 as a dilution liquor and the third sub-washing cycle comprises the washing method using the long liquor.

* * * * *